US007744422B2

(12) United States Patent
Ting et al.

(10) Patent No.: US 7,744,422 B2
(45) Date of Patent: Jun. 29, 2010

(54) ELECTRICAL CARD CONNECTOR FOR RECEIVING AT LEAST TWO ELECTRICAL CARDS

(75) Inventors: Chien-Jen Ting, Tu-cheng (TW); Hung-Chi Yu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/319,480

(22) Filed: Jan. 7, 2009

(65) Prior Publication Data

US 2009/0176387 A1 Jul. 9, 2009

(30) Foreign Application Priority Data

Jan. 7, 2008 (TW) ..... 97100520 A

(51) Int. Cl.
*H01R 24/00* (2006.01)

(52) U.S. Cl. ..... 439/630; 439/159

(58) Field of Classification Search ..... 439/630, 439/157, 310, 541.5, 64, 159
See application file for complete search history.

(56) References Cited

U.S. PATENT DOCUMENTS 5,304,070 A * 4/1994 Bertho et al. ..... 439/157
5,364,275 A * 11/1994 Ota et al. ..... 439/65
6,648,680 B1 * 11/2003 Hu ..... 439/541.5
6,712,627 B2 * 3/2004 Murnaghan et al. ..... 439/159
6,805,582 B2 * 10/2004 Hu ..... 439/567
7,081,021 B1 * 7/2006 Ting ..... 439/630
7,207,810 B2 * 4/2007 Kuo et al. ..... 439/79
2006/0172604 A1 * 8/2006 Ting ..... 439/630
2006/0196781 A1 9/2006 Kimura et al.

FOREIGN PATENT DOCUMENTS

CN 2415469 1/2001

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

The present invention relates to an electrical card connector comprising: a first connector with a plurality of first contacts; a second connector located at the lateral side of the first connector and with a plurality of second contacts; a PCB located at the bottom of the first connector and the second connector; a shell covering the first connector; a bottom plate mounted at the bottom of the shell; the first connector and the second connector are held on the same side of the PCB, a first receiving room is defined between the shell and the bottom plate, and the second receiving room is defined between the bottom plate and the PCB.

20 Claims, 5 Drawing Sheets

ELECTRICAL CARD CONNECTOR FOR RECEIVING AT LEAST TWO ELECTRICAL CARDS

BACKGROUND OF THE INVENTION

1. Field of the Invention

The present invention generally relates to an electrical card connector, and more specially to an electrical card connector for receiving cards with different thickness.

2. Description of Prior Art

A smart card can be used to internet shopping and pay a bill, and a notebook computer always sets a smart card connector for adapting the smart card. The computer also sets an express card connector or other type card connectors. The smart card and the express card have the same width, so the smart card connector and the express card connector are always stacked to save the inner space of the computer.

U.S. Pat. No. 7,207,810, for example, discloses such a stacked electrical card connector comprising an express card connector and a smart card connector. The express card connector comprises an insulative housing, a shell covering the housing and a plurality of contacts received by the housing. The smart card connector comprises a shield plate, a plastic board mating with the shield plate and a terminal module. And the electrical card connector further comprises a transfer device. The transfer device includes a spacer, a daughter board and a rear socket, and the express card connector and the smart card connector are connected to a printed circuit board (PCB) by the transfer device. It is obvious that there are too many components to be assembled, and the cost of the electrical card connector will be high apparently.

Hence, it is desirable to have an improved card connector to overcome the above-mentioned disadvantages of the prior art.

BRIEF SUMMARY OF THE INVENTION

Accordingly, the object of the present invention is to provide an electrical card connector with a simple structure to reduce the assembly procedure and the cost.

In order to achieve the above-mentioned object, an electrical card connector assembly comprises a first connector with a plurality of first contacts; a second connector located at the lateral side of the first connector and with a plurality of second contacts; a PCB located at the bottom of the first connector and the second connector; a shell covering the first connector; a bottom plate mounted at the bottom of the shell; wherein the first connector and the second connector are held on the same side of the PCB, a first receiving room is defined between the shell and the bottom plate, and the second receiving room is defined between the bottom plate and the PCB.

Other objects, advantages and novel features of the invention will become more apparent from the following detailed description of the present embodiment when taken in conjunction with the accompanying drawings.

DETAILED DESCRIPTION OF THE INVENTION

Figure 1:
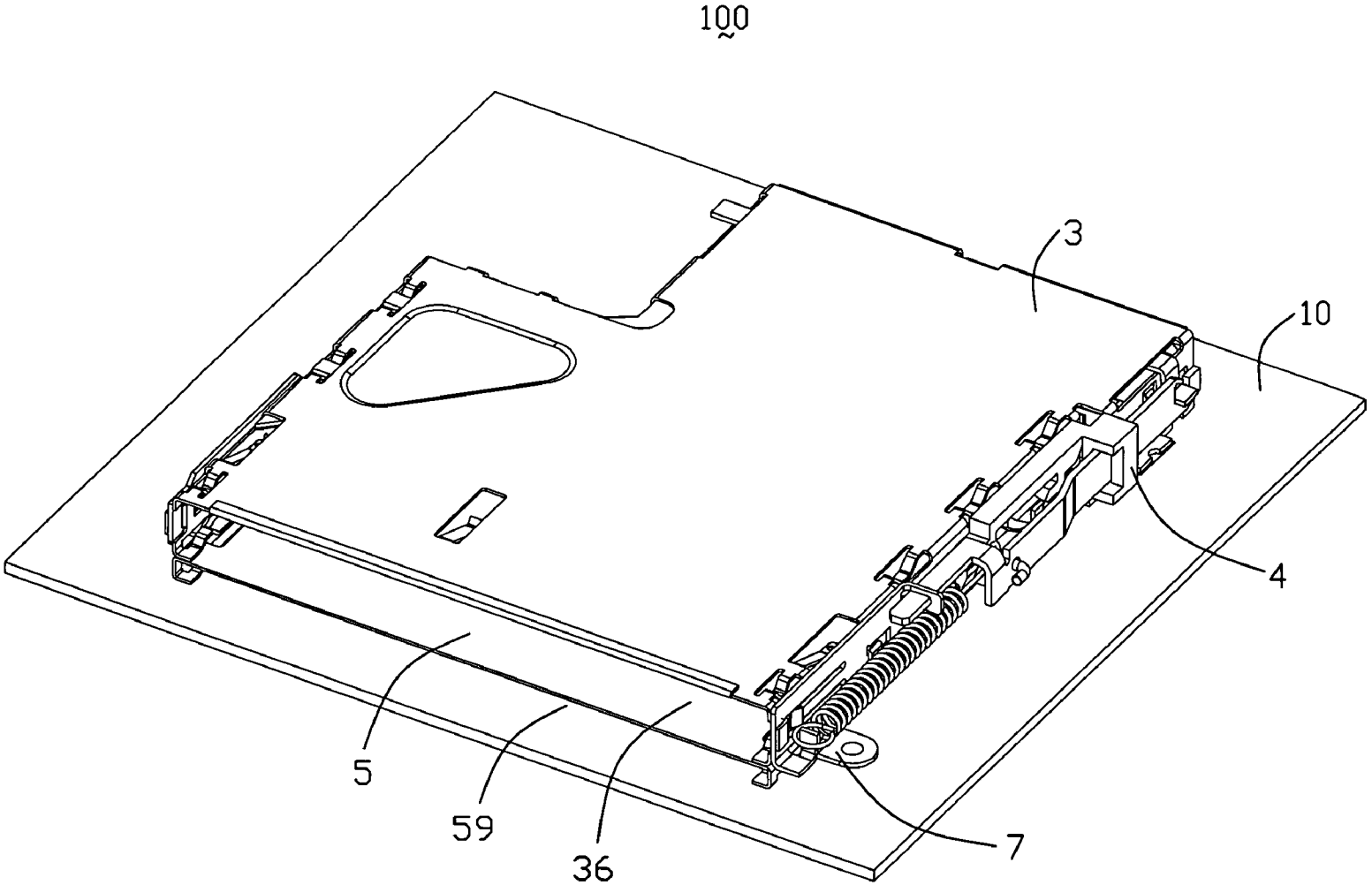
FIG. 1 is a perspective view of an electrical card connector in accordance with the present invention.

Reference will now be made to the drawing figures to describe the present invention in detail.

Referring to FIG. 1 to FIG. 5, an electrical connector 100 is mounted on a PCB 10, comprising a first connector 1, a second connector 2, a shell 3 covering on the first connector 1, an ejector 4 mounted on the lateral side of the shell 3, a bottom plate 5 mounted on the bottom of the shell 3, a guide member 6 and a pair of stand offs 7. The first connector 1 mates with an express card (not shown), and the second connector 2 mates with a smart card (not shown).

Figure 2:
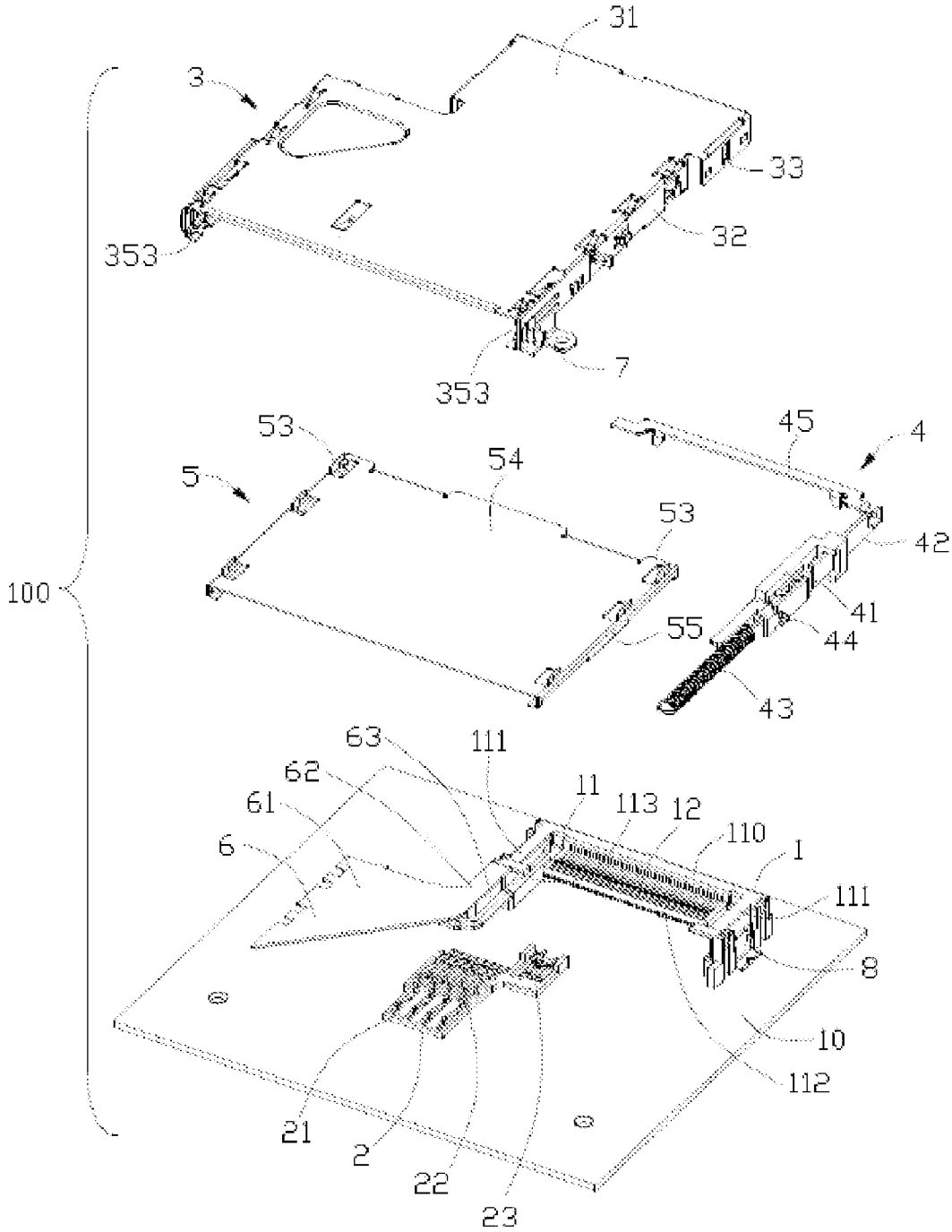
FIG. 2 is an exploded, perspective view of the electrical card connector shown in FIG. 1.
Figure 3:
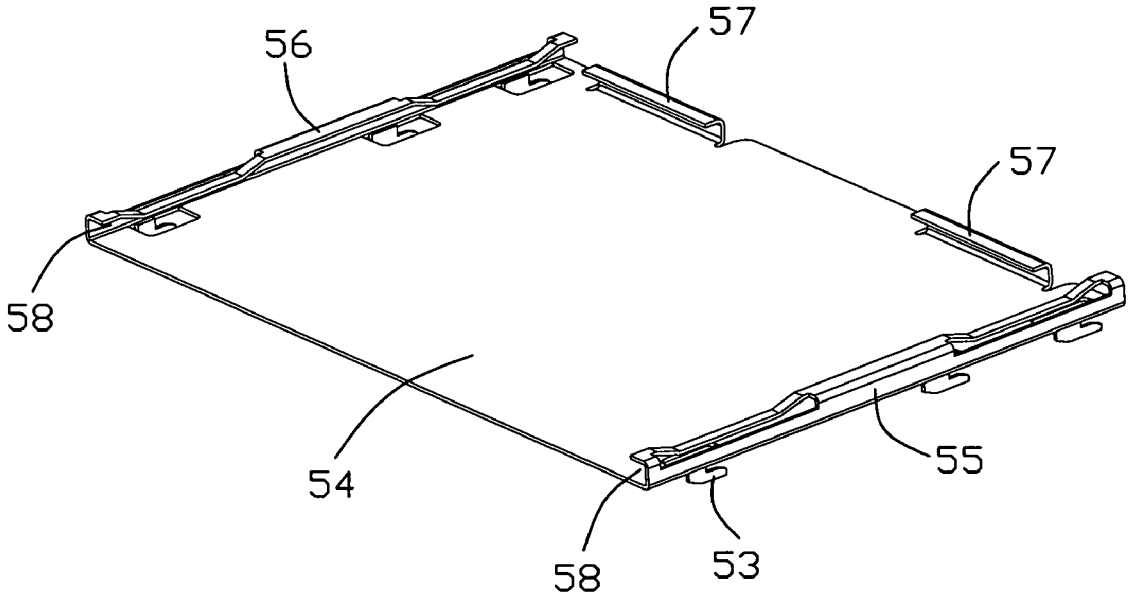
FIG. 3 is a perspective view of the bottom plate of the electrical card connector shown in FIG. 1.

Referring to FIG. 2, the first connector 1 is located at the front of the shell 3, comprising an insulative housing 11 and a plurality of first contacts 12 received by the housing 11. The housing 11 includes a base portion 110, a pair of arms 111 extending from opposite sides of the base portion 110 and a mating portion 112 extending from the base portion 110. The mating portion 112 forms a plurality of passageway (not labeled) for receiving the first contacts 12. A gap (not labeled) is formed between the mating portion 112 and the arms 111 for guiding the express card insertion. A pair of grounding pieces 8 are held on the outside of the arms and soldered on the PCB 10. The whole housing 11 extends downwardly and forms an extending portion 113 which is higher than the second connector 2 (seeing FIG 5).

Figure 4:
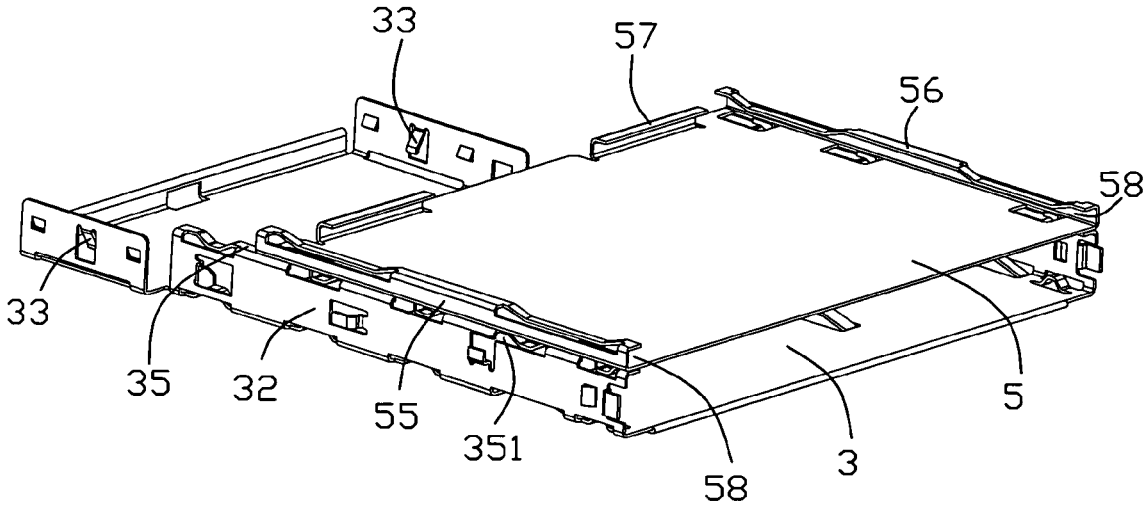
FIG. 4 is a perspective view of the shell and the bottom plate assembled together.
Figure 5:
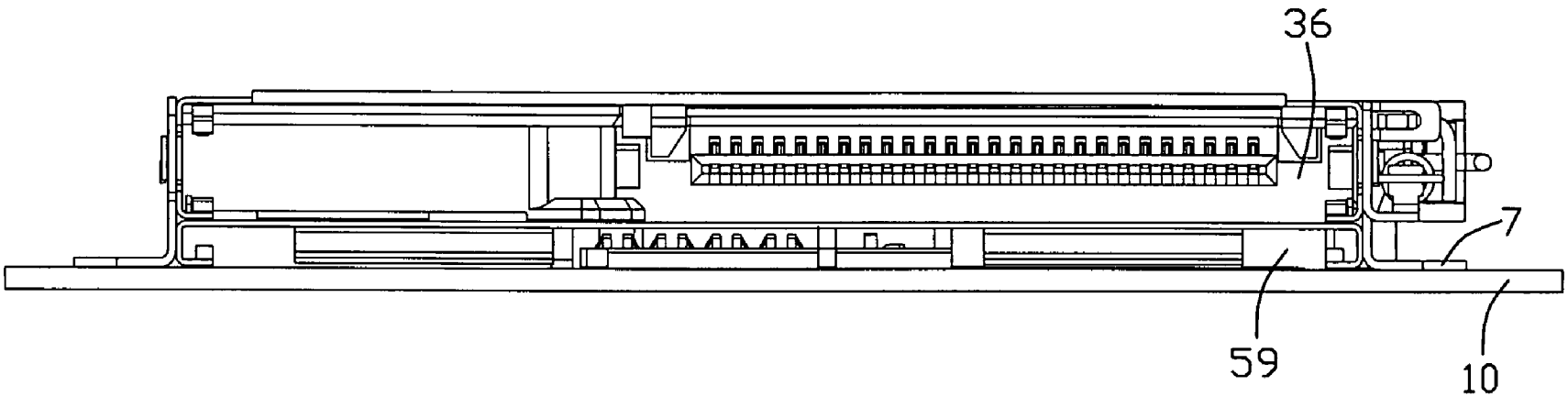
FIG. 5 is a rear view of the electrical card connector shown in FIG. 1.

Referring to FIG. 1, FIG. 2 and FIG. 4, the shell 3 covers on the first connector 1 and comprises an L-shaped main portion 31 and a pair of lateral walls 32 extending downwardly from two lateral sides of the main portion 31. A card inserting opening (not labeled) is defined at the rear end of the shell 3 between the lateral walls 32. The lateral walls 32 further bends inwardly to form a pair of horizontal portions 35. The horizontal portions 35 form a plurality of holes 351 thereon. The horizontal portions 35, the lateral walls 32 and the main portion 31 define a first guiding slot 353 for guiding an L-shaped express card insertion. The shell 3 further has a pair of resilient arms 33 formed at the front portion thereof, and the resilient arms 33 are connected to the grounding pieces 8 electrically.

Referring to FIG. 1 to FIG. 5, the bottom plate 5 is attached to the shell 3 and located at the top of the second connector 2, which comprises a main plate 54, a front wall 57 extending downwardly from the front of the main plate 54, a pair of vertical portions 55 extending downwardly from opposite sides of the main plate 54, and a bending portion 56 extending inwardly from the vertical portion 55. The lateral sides of the main plate 54 form a plurality of hooks 53, which mate with the holes 351 of the shell 3 for holding the bottom plate 5 on the bottom of the shell 3. The main plate 54, the vertical portion 55 and the bending portion 56 defines a second guiding slot 58 for guiding the smart card insertion. The height between the main plate 54 and the PCB 10 corresponds to the height of the extending portion 113. A first receiving room 36 is defined between the shell 3 and the bottom plate 5, and a second receiving room 59 is defined between the bottom plate 5 and the PCB 10.

Referring to FIG. 1 and FIG. 2, the ejector 4 is attached to the longer lateral wall 32 and comprises a holder member 41 having a heart groove (not shown), a push rod 42, a spring 43, a link pin 44 and an ejecting rod 45. The push rod 42 is slidingly assembled on the holder member 41. The spring 43 has a two ends, one end is fasten to the stand off 7 assembled on the shell 3, and the other clasps to the push rod 42 to drive the push rod 42. The link pin 44 connects with the push rod 42 and slides in the heart groove of the holder member 41. The ejecting rod 45 connects with the push rod 42 for ejecting the electrical card from the first receiving room 36.

The guide member 6, approximately in a triangular shape and disposed on one end of the arms 111 adjacent to the insulative housing 11, comprises a board 61 and an L-shaped perpendicular wall 62 extending forwardly and downwardly from a front end of the board 61. The board 61 defines a passageway 63 communicating with the arm 111 for guiding the card insertion.

Referring to FIG. 2, the second connector 2 is soldered on the PCB 10 and located at the rear side of the first connector 1. The first connector 1 and the second connector 2 are held on the same side of the PCB 10. The second connector 2 comprises a main body 21 formed of resin, and a pair of switch contacts 23 and a plurality of second contacts 22 are retained in the main body 21. The second contacts 22 arrange in two rows, but the end of the contacts, soldered on the PCB 10, arranges in one row. The switch contacts 23 are located at the front side of the second contacts 22 and align with the front wall 57 of the bottom plate 5 in a vertical direction.

Referring to FIG. 1 to FIG. 5, the assembly procedure of the electrical card connector 100 as follows: firstly, the first connector 1 and the second connector 2 are soldered on the PCB 10, respectively; secondly, the guider member 6, the stand offs 7 and the ejector 4 are attached to the shell 3, then the bottom plate 5 is held on the shell 3; thirdly, the shell 3 is assembled to the first connector 1, and the stand offs 7 of the shell 3 mate with the PCB 10 for retaining the shell 3. The first step and the second step can be processed at the same time for saving time. The components of the electrical card connector 100 are too few to reduce the assembly procedure and the cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical card connector assembly comprising:

a first connector with a plurality of first contacts for mating with an express card, a second connector located at a lateral side of the first connector and with a plurality of second contacts for the second connector for mating with a smart card;

a PCB located at a bottom of the first connector and the second connector;

a shell covering the first connector;

a bottom plate mounted at a bottom of the shell;

an ejector mounted on a lateral side of the shell;

the bottom plate is attached to the shell and located at a top of the second connector, which comprises a main plate, a front wall extending downwardly from a front of the main plate, a pair of vertical portions extending downwardly from opposite sides of the main plate and a bending portion extending inwardly from each of the vertical portions; lateral sides of the main plate form a plurality of hooks, which mate with holes of the shell for holding the bottom plate on the bottom of the shell; the main plate, the vertical portion and the bending portion define a guiding slot for guiding the smart card;

wherein the second connector comprises a switch contact, aligned with a front wall of the bottom plate in a vertical direction;

wherein the first connector and the second connector are held on the same side of the PCB, a first receiving room is defined between the shell and the bottom plate, and a second receiving room is defined between the bottom plate and the PCB.

2. The electrical card connector assembly as claimed in claim 1, wherein the first connector comprises an insulative housing extending to form an extending portion, the extending portion being higher than the second connector.

3. The electrical card connector assembly as claimed in claim 1, wherein the second connector is located between the bottom plate and the PCB and is disposed in the second receiving room.

4. The electrical card connector assembly as claimed in claim 1, wherein the first receiving room has a same width with the second receiving room, and the first receiving room is higher than the second receiving room.

5. The electrical card connector assembly as claimed in claim 1, wherein a height between the main plate and the PCB is corresponding to a height of an extending portion of the first connector.

6. The electrical card connector assembly as claimed in claim 5, wherein the shell comprise an L-shaped main portion.

7. The electrical card connector assembly as claimed in claim 1, wherein the first contacts and the second contacts are soldered on a same side of the PCB, and the second contacts are located behind of the first contacts.

8. The electrical card connector assembly as claimed in claim 7, wherein the second contacts have respective first ends arranged in two rows and respective second ends soldered on the PCB arranges in one row.

9. The electrical card connector assembly as claimed in claim 1, wherein the shell comprises a narrow portion and a wide portion, and the bottom plate is assembled on a wide portion of the shell.

10. The electrical card connector assembly as claimed in claim 9, wherein, the ejector comprises a push rod, a spring and a link pin and an ejecting rod.

11. The electrical card connector assembly as claimed in claim 10, wherein the bottom plate comprises the front wall extending downwardly from the front thereof, and the front wall is located behind the narrow portion of the shell.

12. The electrical card connector assembly as claimed in claim 11, wherein the switch contacts are located at a front side of the second contacts.

13. An electrical stack card connector comprising:

a first connector for mating with an express card;

a second connector located at a rear of the first connector and for mating with a smart card;

a shell covering on the first connector;

an ejector mounted on a lateral side of the shell;

a bottom plate assembled on a bottom of the shell and located on a top of the second connector;

the bottom plate is attached to the shell and located at a top of the second connector, which comprises a main plate, a front wall extending downwardly from a front of the main plate, a pair of vertical portions extending downwardly from opposite sides of the main plate and a bending portion extending inwardly from each of the vertical portions; lateral sides of the main plate form a plurality of hooks, which mate with holes of the shell for holding the bottom plate on the bottom of the shell; the main plate, the vertical portion and the bending portion define a guiding slot for guiding the smart card;

a first receiving room has a same width with a second receiving room and the first receiving room is higher than the second receiving room;

wherein the second connector comprises a switch contact, aligned with the front wall of the bottom plate in a vertical direction;

wherein the first connector and the second connector are mounted on a same side of a PCB, the bottom plate comprises the front wall and a pair of guiding slots, the guiding slots extend in a card insertion direction for guiding the card, and the front wall is located at the front of the main plate for stopping the card excessively.

14. The electrical stack card connector as claimed in claim 13, wherein the first receiving room is defined between the shell and the bottom plate, and the second receiving room is defined between the bottom plate and the PCB.

15. The electrical stack card connector as claimed in claim 14, wherein the first receiving room is stacked with the second receiving room, and the first receiving room is shallower than the first receiving room in the card insertion direction.

16. The electrical stack card connector as claimed in claim 15, wherein the first connector extends downwardly and forms an extending portion, and the extending portion is higher than the second connector.

17. The electrical stack card connector as claimed in claim 16, wherein the opposite sides of the bottom plate form a plurality of hooks for holding the bottom plate on the bottom of the shell.

18. An electrical eject card connector assembly comprising:

the switch contacts;

first and second connectors stacked with each other;

the first connector defining an L-shaped receiving cavity, in a top view, with a front large space and a rear small space thereof; a plurality of first contacts disposed in the rear small space;

the second connector defining a rectangular receiving cavity configured and dimensioned similar to said front large space; and a plurality of second contacts disposed in a rectangular space; wherein the L-shaped receiving cavity is thicker than the rectangular receiving cavity;

a L-shaped receiving cavity is defined by a first metallic shell, the rectangular receiving cavity is defined by a second metallic shell, and a pair of standoffs retainably engaging said first metallic shell and said second metallic shell;

a second metallic shell which defines at least a stopper at a front edge thereof to avoid excessive forward movement of an electronic card which is inserted into the rectangular receiving cavity;

said second shell is assembled on a bottom of the first shell and located on a top of the second connector; a second shell comprise a main plate, a front wall extending downwardly from a front of the main plate, a pair of vertical portions extending inwardly from the vertical portion; lateral sides of the main plate form a plurality of hooks, a guiding slot for guiding the smart card.

19. The electrical eject card connector as claimed in claim 18, wherein an ejector comprises a push rod, a spring and a link pin and an ejecting rod.

20. The electrical eject card connector as claimed in claim 18, wherein the switch contacts are located at a front side of the second contacts.

* * * * *